US007523742B2

(12) United States Patent
Tsuchiya et al.

(10) Patent No.: US 7,523,742 B2
(45) Date of Patent: Apr. 28, 2009

(54) COMBUSTION GAS SEAL FOR FUEL INJECTION VALVE

(75) Inventors: Tomihisa Tsuchiya, Toyota (JP); Kenji Ohkubo, Toyota (JP); Masaaki Yano, Nishikamo-gun (JP); Iwao Taira, Nihonmatsu (JP); Junichi Nakayama, Fujisawa (JP)

(73) Assignees: Toyota Jidosha Kabushiki Kaisha, Aichi (JP); NOK Corporation, Tokyo (JP)

( * ) Notice: Subject to any disclaimer, the term of this patent is extended or adjusted under 35 U.S.C. 154(b) by 0 days.

(21) Appl. No.: 10/580,311

(22) PCT Filed: Oct. 22, 2004

(86) PCT No.: PCT/JP2004/015727

§ 371 (c)(1),
(2), (4) Date: Apr. 2, 2007

(87) PCT Pub. No.: WO2005/052360

PCT Pub. Date: Jun. 9, 2005

(65) Prior Publication Data

US 2007/0272214 A1 Nov. 29, 2007

(30) Foreign Application Priority Data

Nov. 25, 2003 (JP) ..... 2003-393553

(51) Int. Cl.
*F02M 61/14* (2006.01)

(52) U.S. Cl. ..... 123/470

(58) Field of Classification Search ..... 123/470
See application file for complete search history.

(56) References Cited

U.S. PATENT DOCUMENTS

| | | | | | |
|---|---|---|---|---|---|
| 3,695,235 | A * | 10/1972 | Anderson | 239/533.1 |
| 4,506,645 | A * | 3/1985 | Hewlitt et al. | 123/470 |
| 4,589,596 | A * | 5/1986 | Stumpp et al. | 239/397.5 |
| 6,009,856 | A * | 1/2000 | Smith et al. | 123/470 |
| 6,295,969 | B1 * | 10/2001 | Kato et al. | 123/470 |
| 6,427,667 | B1 | 8/2002 | Kato | |
| 6,811,102 | B2 * | 11/2004 | Krause et al. | 239/533.2 |
| 6,843,233 | B2 * | 1/2005 | Berger et al. | 123/468 |

(Continued)

FOREIGN PATENT DOCUMENTS

EP 1326022 7/2003

(Continued)

OTHER PUBLICATIONS

Japanese Office Action dated May 7, 2008 and English translation.

*Primary Examiner*—Stephen K Cronin
*Assistant Examiner*—Arnold Castro
(74) *Attorney, Agent, or Firm*—Jacobson Holman PLLC

(57) ABSTRACT

Leakage of a combustion gas is prevented by installing a seal ring in an annular groove provided in the outer peripheral surface of a fuel injection valve. Further, a combustion gas leaked from the seal ring is sealed in by providing a seal washer more on the rear end side of the fuel injection valve than the seal ring. Thus a combustion gas seal for an injection valve is provided, and the combustion gas seal is capable of exhibiting excellent sealing ability for a long term with a simple structure.

1 Claim, 4 Drawing Sheets

U.S. PATENT DOCUMENTS

| | | | | |
|---|---|---|---|---|
| 7,069,908 | B2 | 7/2006 | Ohkubo et al. | |
| 2002/0157648 | A1 * | 10/2002 | Reiter | 123/470 |
| 2003/0183201 | A1 * | 10/2003 | Hans | 123/470 |
| 2005/0016501 | A1 * | 1/2005 | Krause et al. | 123/470 |
| 2005/0066942 | A1 | 3/2005 | Ohkubo et al. | |

FOREIGN PATENT DOCUMENTS

| | | |
|---|---|---|
| JP | 04-086371 | 3/1992 |
| JP | 11-210600 | 8/1999 |
| JP | 11-294302 | 10/1999 |
| JP | 2002-257239 | 9/2002 |
| JP | 2003-343727 | 3/2003 |
| JP | 2004-036775 | 2/2004 |
| JP | 2004-239124 | 8/2004 |
| JP | 2005-098238 | 4/2005 |

* cited by examiner

COMBUSTION GAS SEAL FOR FUEL INJECTION VALVE

This is a nationalization of PCT/JP04/015727 filed Oct. 22, 2004 and published in Japanese.

TECHNICAL FIELD

The present invention relates to a combustion-gas seal for a fuel injection valve, the seal preventing leakage of combustion gas by sealing an annular clearance gap between the fuel injection valve and a mounting hole therefor.

BACKGROUND ART

A direct injection engine has adopted a configuration in which a fuel injection valve is mounted onto a mounting hole in a cylinder head (housing), and fuel is injected directly into a cylinder from a nozzle at the tip of this fuel injection valve. Accordingly, it is required to prevent leakage of combustion gas at high pressure from an annular clearance gap between the fuel injection valve and the mounting hole.

A structure in which an annular groove is provided on an outer peripheral surface of the fuel injection valve, and a rubber or resin seal ring is installed into the annular groove has been known as a sealing structure against the leakage (refer to patent documents 1 through 6). Moreover, a configuration in which two kinds of seal rings, rubber and resin, are combined has been proposed in a patent document 7, and a configuration in which a metal ring is arranged on the tip side of a rubber O-ring has been proposed in a patent document 8.

[Patent Document 1]: Japanese Laid-Open Patent Application Publication No. 2002-070696,

[Patent Document 2]: Japanese Laid-Open Patent Application Publication No. 2002-081548,

[Patent Document 3]: Japanese Laid-Open Patent Application Publication No. 2002-081549,

[Patent Document 4]: Japanese Laid-Open Patent Application Publication No. 2002-202030,

[Patent Document 5]: Japanese Laid-Open Patent Application Publication No. 2002-317733,

[Patent Document 6]: Japanese Laid-Open Patent Application Publication No. 2002-364494,

[Patent Document 7]: Japanese Laid-Open Patent Application Publication No. 11-013593, and

[Patent Document 8]: Japanese Laid-Open Patent Application Publication No. 2000-310332.

DISCLOSURE OF THE INVENTION

Problems that this Invention is to Solve

When an engine is operated, the tip portion of a fuel injection valve is always exposed to combustion gas at high temperature and high pressure. Therefore, damage of a seal ring installed in the tip portion of the fuel injection valve proceeds comparatively fast, and sealing ability easily becomes unstable. Especially, a seal of resin such as PTFE (polytetrafluoroethylene) has had a problem that the sealing ability is remarkably degraded at low temperature to cause a large quantity of leakage.

Here, it is also considered that the position of the seal is configured to be held away from the tip portion of the fuel injection valve for control of damage of the seal. However, the temperature of the tip portion of a fuel injection valve remarkably rises in the above case because an entering quantity of combustion gas into an annular clearance gap is increased.

Then, a deposit, which adheres to the neighborhood of the fuel injection nozzle of the fuel injection valve, is increased to cause a malfunction such as reduction in the injecting quantity of fuel and deterioration in the fuel injecting response in some cases.

Moreover, the damage of a seal is considered to be controlled by installing two seal rings in the tip portion of the fuel injection valve, as proposed in the patent documents 7 and 8. However, the above configuration is not preferable because steps for assembling the seal onto the fuel injection valve are increased to cause reduction in the productivity. Especially, a resin seal with a low elastic recovery requires a correcting step at installation of the seal into an annular groove, while an enlarged diameter is returned to an original one at the correcting-step (refer to the patent document 6). Accordingly, the increase in the number of seals causes remarkable reduction in the productivity.

The present invention has been made, considering the above circumstances, and one of its objects is to provide a combustion-gas seal for a fuel injection valve with a simple configuration, wherein the seal can exhibit an excellent sealing ability for a long term.

Moreover, another object of the present invention is to provide a combustion-gas seal for a fuel injection valve, wherein the seal can realize both maintenance of the sealing ability of the seal, and control of temperature rise at the tip portion of the fuel injection valve.

Further another object of the present invention is to provide a combustion-gas seal for a fuel injection valve, wherein the seal can reduce steps for assembling a plurality of seals onto the fuel injection valve and can improve the productivity.

Means for Solving the Problems

The combustion-gas seal for a fuel injection valve according to the present invention seals an annular clearance gap between a mounting hole provided in a housing such as a cylinder head and a fuel injection valve mounted in the mounting hole, and adopts the following configurations.

The present invention is provided with a seal ring installed into an annular groove provided on the outer peripheral surface of a fuel injection valve. This seal ring prevents leakage of combustion gas by seal contact with the bottom surface of the annular groove and the peripheral surface of the mounting hole.

The present invention may have a configuration in which a seal washer is sandwiched between the housing and the fuel injection valve at a position toward the rear end of the fuel injection valve from the seal ring. Thereby, the seal washer can function as a secondary seal, and combustion gas which leaks from the seal ring can be surely sealed by the seal washer. Accordingly, a sealing ability of the whole combustion-gas seal for a fuel injection valve is improved, and an excellent sealing ability is realized for a long term.

Moreover, the position at which the seal ring is installed may be set, by providing the seal washer as a secondary seal, at a position toward the tip of the fuel injection valve, because the allowable damaged and leakage ranges of the seal ring itself may be extended. Then, an advantage that temperature rise at the tip portion of the fuel injection valve is controlled may be expected.

Furthermore, as the fuel injection valve is fastened into the housing, the seal washer is simultaneously sandwiched (assembled). Accordingly, steps for assembling the seal onto the fuel injection valve are not increased. That is, addition of the seal washer does not cause reduction in the productivity.

Here, the seal washer preferably has a metal ring and a rubber-like elastic portion which is fitted to the metal ring by baking. Since the rubber-like elastic portion is provided, an followability to a seal surface (a housing wall surface and/or the wall surface of a fuel injection valve) and high degree of adhesion thereto are improved, and preferable sealing ability is realized.

The present invention is preferably provided with a heat-resistant ring installed into a second annular groove provided at a position toward the tip side of the fuel injection valve from the annular groove. Since the heat-resistant ring is provided, the entering quantity of combustion gas into the annular clearance gap can be reduced. Since the load put on the seal ring can be reduced, damage of the seal ring can be controlled and an excellent sealing ability can be realized for a long term.

Moreover, since temperature rise at the tip portion of the fuel injection valve is controlled by providing the heat-resistant ring, adhesion of deposit can be prevented, and stable movement of the fuel injection valve can be maintained.

Here, the seal ring and the heat-resistant ring preferably have approximately the same outside diameter. The above configuration enables shareability of an installing jig, which installs a ring into a groove of the fuel injection valve, while the inside diameter of the ring is being extended, and a correcting jig, which corrects the diameter which has been extended when the ring is installed, between the seal ring and the heat-resistant ring. Accordingly, the seal ring and the heat-resistant ring can be sequentially installed and corrected, using one set of the installing jig and the correcting jig, that is, step reduction and improved productivity can be realized.

For example, the following assembling methods can be adopted. Here, the after-described assembling methods may be preferably applied not only to a case in which a seal ring and a heat-resistant ring are assembled onto a fuel injection valve, but also to a case in which two or more rings with approximately the same outside diameter are assembled onto one member.

An assembling method by which a first ring (seal ring) is assembled into a first annular groove of the member (fuel injection valve), and a second ring (heat-resistant ring) with approximately the same outside diameter as that of the first ring is assembled into a second annular groove provided at a position toward the tip side of the member from the first annular groove has the following steps of:

arranging a correcting jig at a position toward the rear end of the member from the first ring;

arranging an installing jig, which covers the second annular groove, at a position at which the first ring can be led into the first annular groove;

installing the first ring into the first annular groove, using the installing jig;

relatively sliding the installing jig to a position at which the second ring can be led into the second annular groove;

correcting the first ring by relatively sliding the correcting jig to a position for installing the first ring;

installing the second ring into the second annular groove by means of the installing jig during the correction of the first ring; and correcting the second ring by relatively sliding the correcting jig to a position for installing the second ring.

Here, "relatively sliding" means that a jig or a member, or the both of them may be slidden.

EFFECT OF THE INVENTION

According to the combustion-gas seal for a fuel injection valve of the present invention, excellent sealing ability may be realized for a long term with a simple structure.

Moreover, both maintenance of the sealing ability and control of temperature rise in the tip portion of a fuel injection valve may be simultaneously obtained.

Furthermore, step reduction and improved productivity can be realized, when a plurality of seals are assembled onto a fuel injection valve.

DETAILED DESCRIPTION OF THE PREFERRED EMBODIMENTS

Hereinafter, preferable embodiments according to the present invention will be illustratively explained in detail, referring to drawings. However, with regards to sizes, materials, shapes, and relative arrangements, and the like for components described in the embodiments, the scope of the present invention are not limited to the above embodiments, unless otherwise specified.

First Embodiment

Figure 1:
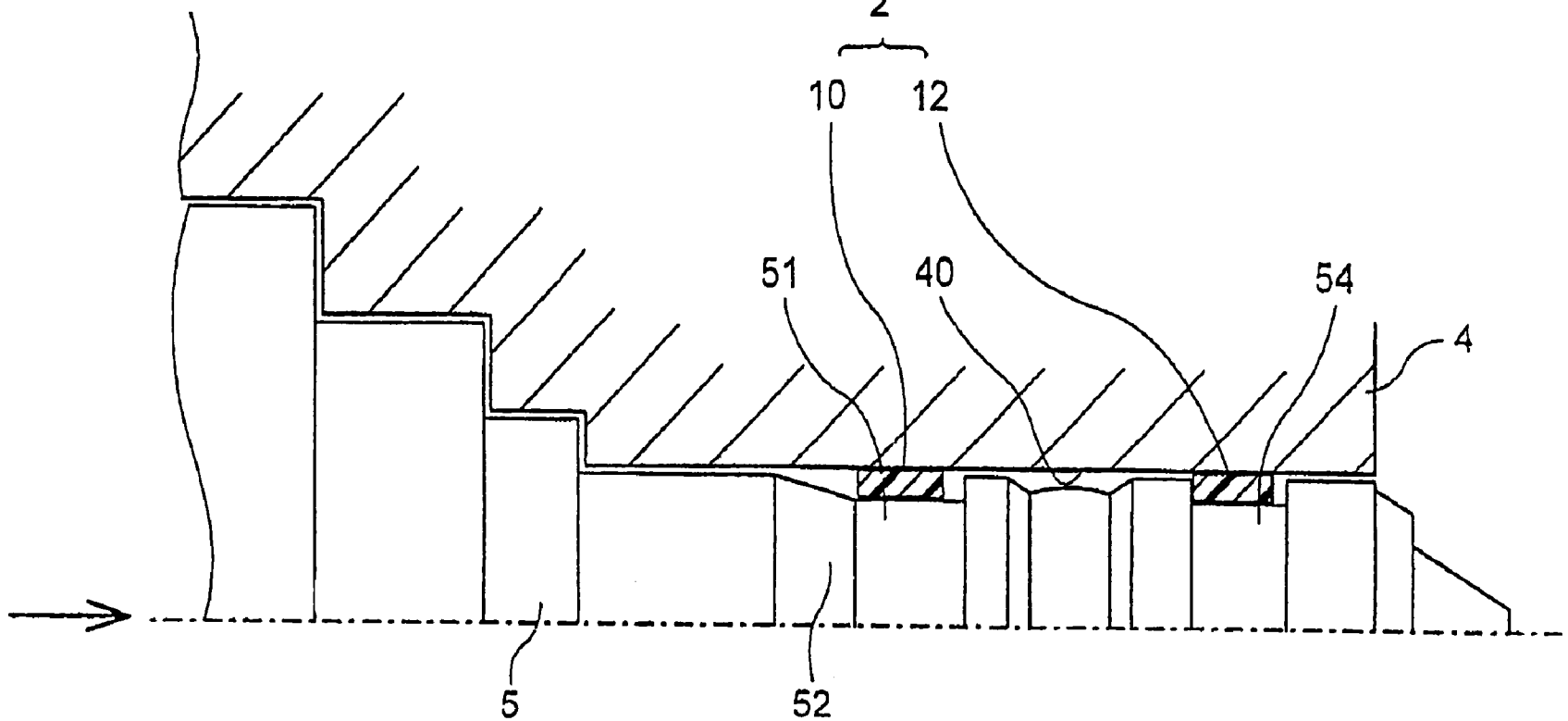
FIG. 1 is a view showing a state in which a combustion-gas seal for a fuel injection valve according to a first embodiment of the present invention is assembled onto a fuel injection valve.

FIG. 1 is a view showing a state in which a combustion-gas seal for a fuel injection valve according to a first embodiment of the present invention is assembled onto a fuel injection valve.

The combustion-gas seal 2 for a fuel injection valve (hereinafter, simply called "combustion-gas seal") prevents leakage of combustion gas from the side near a cylinder (right-hand side in the drawing) by sealing an annular clearance gap between a mounting hole 40 provided in a cylinder head (housing) 4 of a direct injection engine and a fuel injection valve 5 mounted in the mounting hole 40.

The combustion-gas seal 2 according to the present embodiment includes a seal ring 10 as a main seal, and a heat-resistant ring 12 as a thermoprotector.

The seal ring 10 is a seal ring with a rectangular cross section, and the ring is installed into an annular groove 51 provided on the outer peripheral surface at the tip portion of the fuel injection valve 5. A rubber-like elastic material or a resin material may be used as the material of the seal ring 10, but, considering the temperature and the components and the like of the combustion gas, it is preferable to use a heat-resistant material with a high resistance to chemicals. For example, PTFE (polytetrafluoroethylene) may be preferably used.

The inside diameter of the seal ring 10 is set to be a little smaller than the diameter of the bottom surface of the annular groove 51, and the outside diameter is also set to be slightly larger than the diameter of the peripheral surface of the mounting hole 40, wherein the surface is opposing to the annular groove 51. Because the seal ring 10 has such a squeeze, when the fuel injection valve 5 is mounted into the mounting hole 40, compressive deformation is caused in the seal ring 10, and the seal ring comes hermetically contact with the bottom surface of the annular groove 51 and the peripheral surface of the mounting hole 40 due to an elastically recovering force. Thereby, the leakage of the combustion gas from the cylinder side is prevented.

Moreover, in the present embodiment, the annular groove 51 is provided with a tapered portion 52 on the bottom surface thereof, and the tapered portion is configured such that closer to the rear end of the fuel injection valve (left-hand side in the drawing), the depth of the groove become shallower. Thereby, when the pressure of the combustion gas is applied to the seal ring 10, and the ring 10 is moved backward in the groove, the degree of adhesion by the seal ring 10 is improved to cause better sealing ability.

The heat-resistant ring 12 is a ring-like member with a rectangular cross section, wherein the member is installed into a second annular groove 54 provided at a position toward the tip side of a fuel injection valve from an annular groove 51 in which the seal ring 10 is installed. The heat-resistant ring 12 reduces the entering quantity of combustion gas into an annular clearance gap in the vicinity of the tip end of the fuel injection valve 5.

The heat-resistant ring 12 is preferably arranged in the vicinity of the tip end of the fuel injection valve 5 in order to enhance the reducing effect of the entering quantity of the fuel gas. On the other hand, the seal ring 10 is preferably configured to be held away to a certain degree from the tip end of the fuel injection valve 5 for control of damage by fuel gas.

According to the configuration in the present embodiment, damage of the seal ring 10 can be controlled and an excellent sealing ability can be realized for a long term, because the heat-resistant ring 12 reduces the entering quantity of combustion gas to reduce load put on the seal ring 10.

Moreover, since temperature rise at the tip portion of the fuel injection valve is controlled by providing the heat-resistant ring 12, adhesion of deposit can be prevented, and stable movement of the fuel injection valve 5 can be maintained.

Considering the temperature, the components, and the like of the combustion gas, it is preferable to use a high heat-resistant material with a high resistance to heat and chemicals as the material of the heat-resistant ring 12. For example, a resin material such as PTFE (polytetrafluoroethylene) may be preferably used.

Since the heat-resistant ring 12 is required only to have sealing ability necessary and sufficient for reduction in the entering quantity of combustion gas, a squeeze may be provided, or may not be provided. When the squeeze is provided, the reducing effect of the entering quantity of combustion gas is enhanced, because the sealing ability of the heat-resistant ring 12 is improved. On the other hand, when the squeeze is not provided, there is an advantage that the fuel injection valve 5 can be more easily assembled into a mounting hole 40. Moreover, it is preferable to improve the sealing ability of the heat-resistant ring 12 by providing a tapered portion similar to that of the annular groove 51 on the bottom surface of the second annular groove 54.

In the present embodiment, the outside diameter of the heat-resistant ring 12 is configured to be approximately the same as that of the seal ring 10 (regardless of the presence of the squeeze). The above configuration enables shareability of an installing jig and a correcting jig, and reduction in the number of assembling steps is realized.

Then, a method for assembling the seal ring 10 and the heat-resistant ring 12 onto the fuel injection valve will be specifically explained, referring to FIG. 2A through FIG. 2D.

Figure 2B:
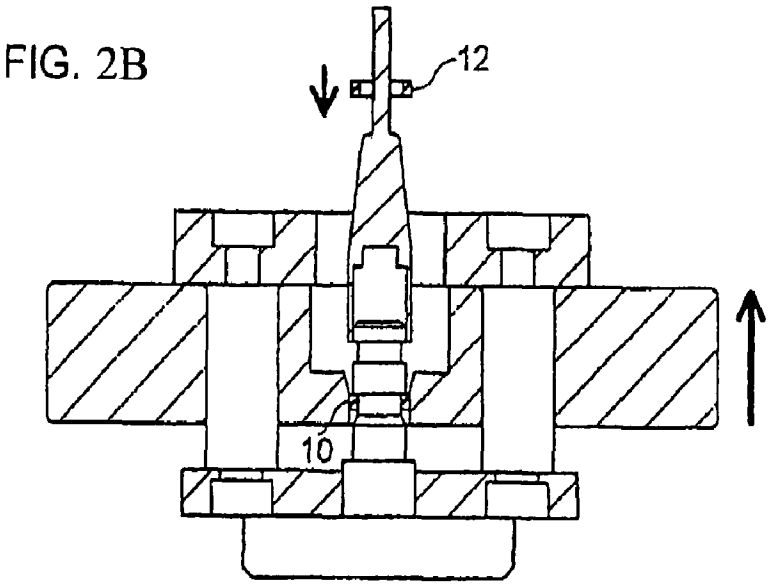
FIG. 2B is a view explaining a method by which a seal ring and a heat-resistant ring are assembled onto a fuel injection valve.
Figure 2D:
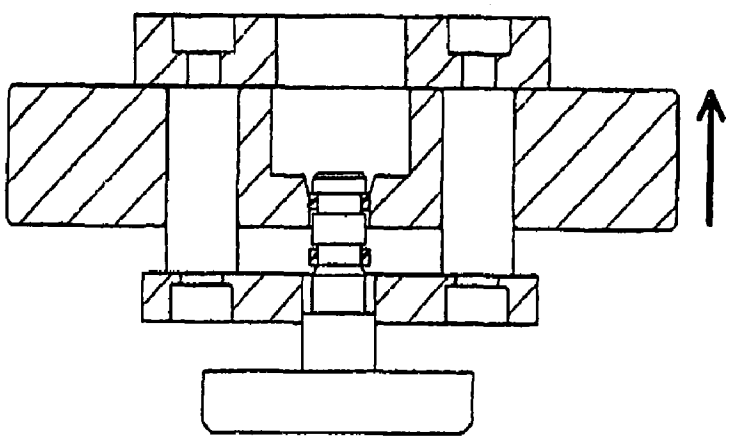
FIG. 2D is a view explaining a method by which a seal ring and a heat-resistant ring are assembled onto a fuel injection valve.
Figure 2A:
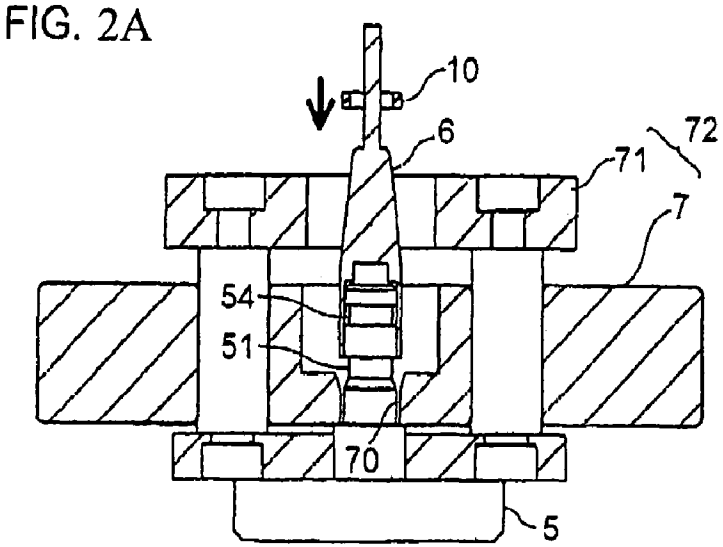
FIG. 2A is a view explaining a method by which a seal ring and a heat-resistant ring are assembled onto a fuel injection valve.

As shown in FIG. 2A and FIG. 2B, an installing jig 6 installs a ring into a groove of the fuel injection valve 5, while the inside diameter of the ring is being extended. The diameter of the installing jig 6 at the lead-in side (upper side in the drawing) for the ring is configured to be enough smaller than the inside diameter of the ring. Then, the diameter of the installing jig 6 gradually becomes larger from the middle thereof toward the side (lower side in the drawing), near the position on which the ring is installed, in a conical manner. A cylinder portion is provided at the lower end of the installing jig 6, and the ring can be led into the groove by covering the tip portion of the fuel injection valve with the cylinder portion.

On the other hand, a correcting jig 7 corrects the diameter which has been extended when the ring is installed. The correcting jig 7 has a correcting hole 70 in accordance with the (original) outside diameter of the ring. The correcting jig 7 is supported by a base 71 in such a way that the jig 7 can be slidden in the axis direction (vertical direction in the drawing) of the fuel injection valve 5 and a correcting jig assembly 72 includes the correcting jig 7 and the base 71.

As shown in FIG. 2A, the fuel injection valve 5 is inserted into the correction hole 70 of the correcting jig 7 in the first place for positioning. At this time, the correcting jig 7 is arranged in the annular groove 51 at the side (lower side in the drawing) near the rear end of the fuel injection valve.

Then, the installing jig 6 is put onto the tip portion of the fuel injection valve 5 for positioning. At this time, the installing jig 6 covers the And, while the inside diameter of the seal ring 10 is gradually extended by leading the seal ring 10 onto the installing jig 6 and by sliding the ring along the peripheral surface of the installing jig 6 from the lead-in side, the seal ring 10 is installed into the annular groove 51. Since the ring of the resin material has low elasticity, it is not easy to return the diameter to the initial one only by the elastically recovering force of its own.

Then, after installing the seal ring 10, the correcting jig 7 is relatively slidden to an installing position of the seal ring 10 as shown in FIG. 2B, and correction of the seal ring 10 is executed.

As the correction is executed, the installing jig 6 is relatively slidden in a simultaneous manner to a position at which the heat-resistant ring 12 can be led into the second annular groove 54, and the heat-resistant ring 12 is installed into the second annular groove 54 during the correction of the seal ring 10.

Figure 2C:
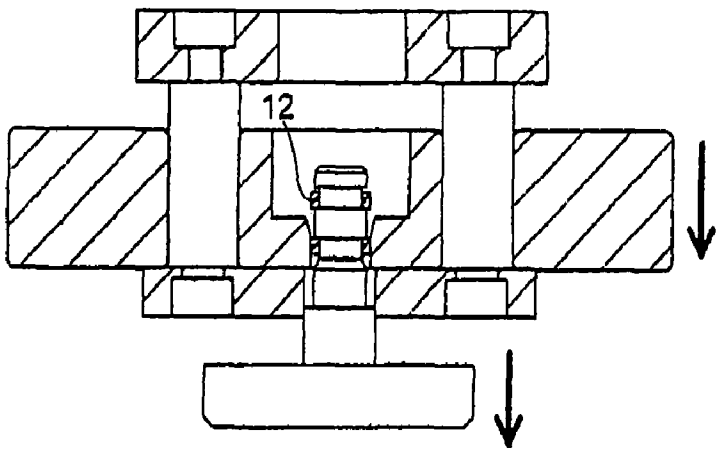
FIG. 2C is a view explaining a method by which a seal ring and a heat-resistant ring are assembled onto a fuel injection valve.

After installing the heat-resistant ring 12, the installing jig 6 is removed, as shown in FIG. 2C, and the fuel injection valve 5 and the correcting jig 7 are sudden downward for positioning of the fuel injection valve 5 at the position.

Then, the heat-resistant ring 12 is corrected by relatively sliding the correcting jig 7 to a position for installing the heat-resistant ring 12, as shown in FIG. 2D, after completing the correction of the seal ring 10.

According to the above-described assembling method, the seal ring 10 and the heat-resistant ring 12 can be sequentially installed and corrected, and the heat-resistant ring 12 can be installed during correction of the seal ring 10, using one set of the installing jig and the correcting jig. Accordingly. step reduction and improved productivity can be realized.

Second Embodiment

Figure 3:
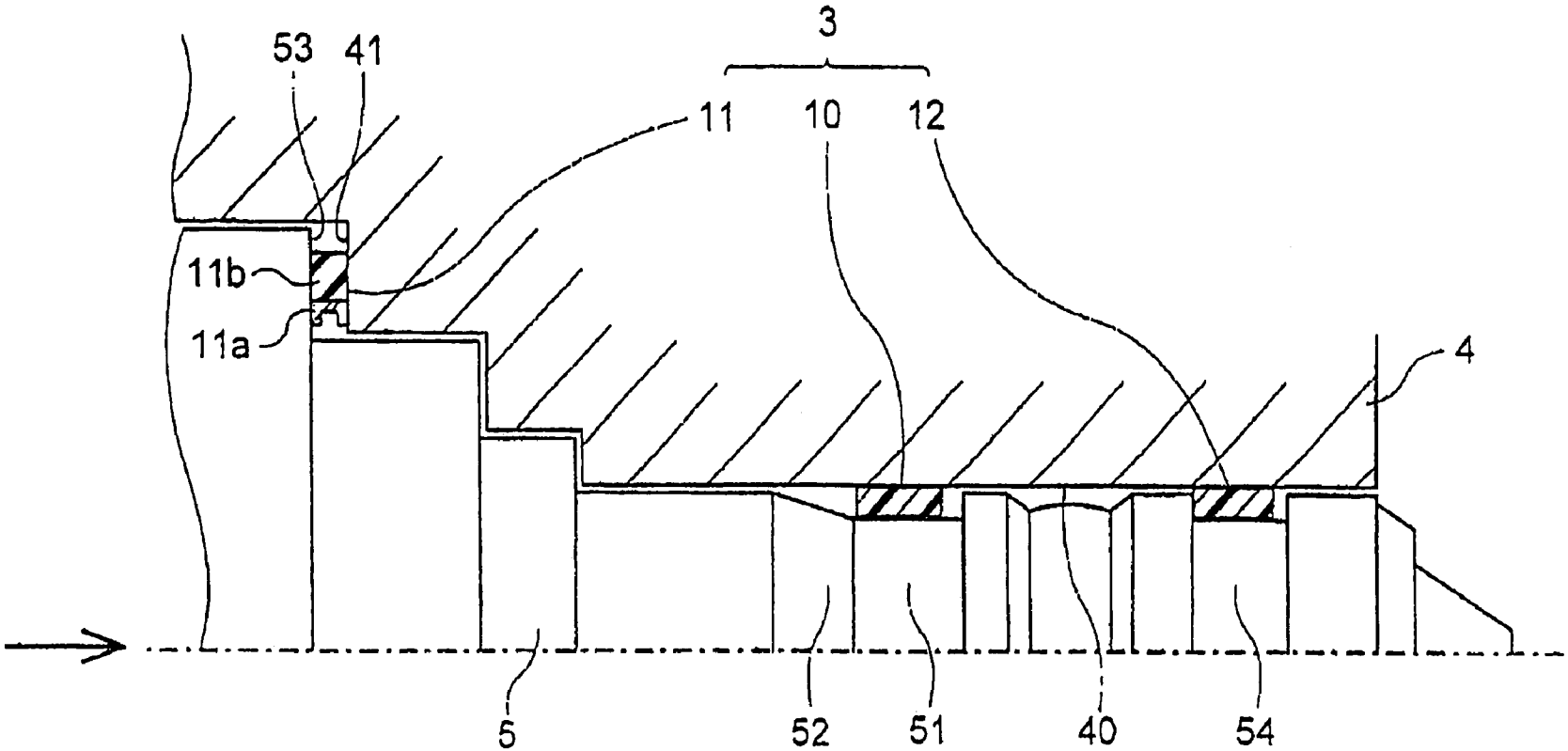
FIG. 3 is a view showing a state in which a combustion-gas seal for a fuel injection valve according to a second embodiment of the present invention is assembled onto a fuel injection valve.
Figure 4:
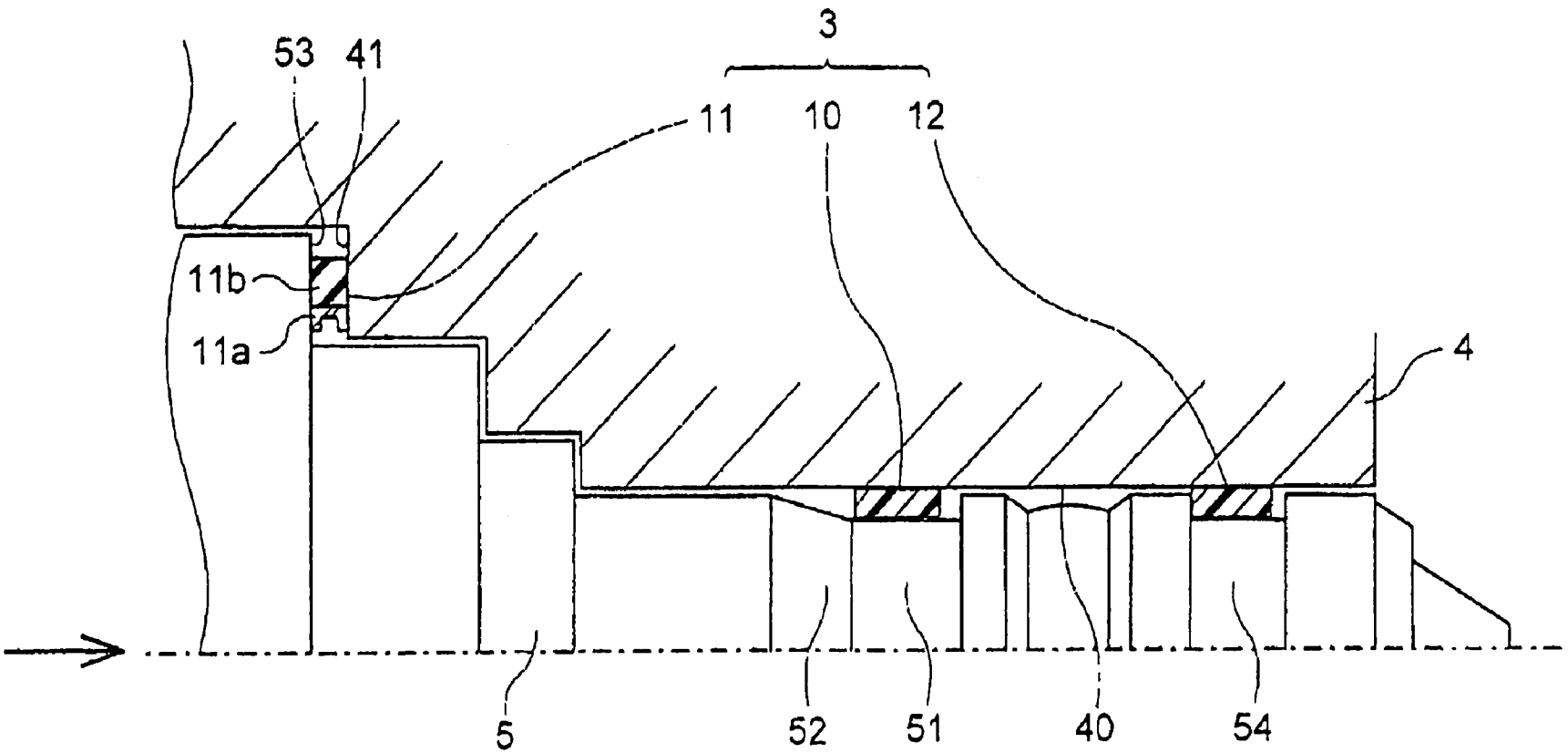

FIG. 3 is a view showing a state in which a combustion-gas seal for a fuel injection valve according to a second embodiment of the present invention is assembled onto a fuel injection valve. In FIG. 3, portions similar to those in the above-described first embodiment (FIG. 1) are denoted by the same reference numerals as those in FIG. 1 and FIG. 2.

A combustion-gas seal 3 according to the present embodiment includes a seal ring 10 as a main seal, a seal washer 11 as a secondary seal, and a heat-resistant ring 12 as a thermo-protector. Configurations of the seal ring 10 and the heat-resistant ring 12 in the present embodiment are similar to those in the above-described embodiments.

A seal washer 11 includes a metal ring 11*a*, and a rubber-like elastic portion 11*b* which is fitted to the outer peripheral surface of the metal ring 11*a* by baking. Considering the environments around an engine room, a material with a heat resistance up to about 120° C. through 150° C. is preferable as a material for the rubber-like elastic portion 11*b* on a higher temperature side. Moreover, a material which can exhibit the rubber-like elasticity even at about −40° C. is preferable for a lower temperature side.

The seal washer 11 is sandwiched and fixed between the cylinder head 4 and the fuel injection valve 5 at a position toward the rear end of the fuel injection valve from the seal ring 10. That is, when the fuel injection valve 5 is fastened into the cylinder head 4, the seal washer 11 is configured to be fixed by holding the metal ring 11*a* between the step surface 53 of the fuel injection valve 5 and the step surface 41 of the mounting hole 40, those surfaces are extended in a direction approximately perpendicularly to the mounting direction (direction indicated by an arrowhead in the drawing) of the fuel injection valve.

In the present embodiment, the sectional shape of the metal ring 11*a* is configured to be a U-shape opening inwardly on the inner peripheral surface. Thereby, when the metal ring 11*a* is sandwiched between two step surfaces 53 and 41, the ring 11*a* is compressed and deformed in the mounting direction of the fuel injection valve, and applies strong pressing force to the step surfaces 53 and 41 by the elastically recovering force. That is, the metal ring 11*a* functions as a metal leaf spring to improve the stability for installing the seal washer 11.

When the washer 11 is fixed as described above, the rubber-like elastic portion 11*b* is adhered to the step surfaces 53 and 41. Since the rubber-like elastic portion 11*b* is very elastic, the rubber-like elastic portion 11*b* has an excellent followability to the step surfaces 53 and 41 as a seal surface and high degree of adhesion thereto, that is, preferable sealing ability is realized.

At this time, it is further preferable to add a lip to the rubber-like elastic portion 11*b*. That is, the lip has a configuration in which the width of at least a part of the rubber-like elastic portion 11*b* in the mounting direction of the fuel injection valve is wider than that of the metal ring 11*a* to secure a squeeze for the step surfaces 53 and 41. Thereby, when the rubber-like elastic portion 11*b* is sandwiched between the step surfaces 53 and 41, the rubber-like elastic portion 11*b* is compressed in the mounting direction of the fuel injection valve, and adhesion force to the step surfaces 53 and 41 is increased by the elastically recovering force (so-called self-sealing function). Accordingly, the sealing ability may be further improved.

According to the configuration in this embodiment described above, the seal washer 11 can function as a secondary seal, and combustion gas which leaks from the seal ring 10 can be surely sealed by the seal washer 11. Accordingly, a sealing ability of the whole combustion-gas seal is improved, and an excellent sealing ability is realized for a long term.

Moreover, the position at which the seal ring 10 is installed may be set, by providing the seal washer 11 as a secondary seal, at a position toward the tip of the fuel injection valve 5 (toward the right-hand side in the drawing), because the allowable damaged and leakage ranges of the seal ring 10 itself may be extended. Then, an advantage that temperature rise at the tip portion of the fuel injection valve is controlled may be expected.

Furthermore, as the fuel injection valve 5 is fastened into the cylinder head 4, the seal washer 11 is simultaneously sandwiched (assembled). Accordingly, only the seal ring 10 is assembled as a seal onto the fuel injection valve 5 itself without increasing steps for assembling the seal onto the fuel injection valve 5 itself. That is, addition of the seal washer 11 does not cause reduction in the productivity.

According to the configuration of the present embodiment, a highly-reliable combustion-gas seal with advantages including both those of the combustion-gas seal according to the first embodiment and those of the above-described seal washer may be provided.

DESCRIPTION OF REFERENCE NUMERALS

2, 3 Combustion-gas seal for fuel injection valve
4 Cylinder head
5 Fuel injection valve
6 Installing jig
7 Correcting jig
10 Seal ring
11 Seal washer
11*a* Metal ring
11*b* Rubber-like elastic portion
12 Heat-resistant ring
40 Mounting hole
41 Step surface
51 Annular groove
52 Tapered portion
53 Step surface
54 Second annular groove
70 Correcting hole
71 Base
72 Correcting jig assembly

The invention claimed is:

1. A combustion-gas seal for a fuel injection system comprising an annular clearance gap between a mounting hole provided in a housing and a fuel injection valve mounted in the mounting hole, a main seal ring of resin installed in an annular groove provided on an outer peripheral surface of the fuel injection valve and far from a tip side of the fuel injection valve, the main seal ring having an elastic recovery feature, a seal washer sandwiched between the housing and the fuel injection valve at a position toward a rear end of the fuel injection valve from the seal ring, the seal washer including a metal ring and a rubber-like elastic portion fitted to the metal ring, the rubber-like elastic portion fitting an outer peripheral surface of the metal ring with the rubber-like elastic portion being located radially outwardly from the metal ring with respect to a mounting direction of the fuel injection valve, and a heat-resistant ring of resin installed in a second annular groove provided at a position toward the tip side of the fuel injection valve from the annular groove, and having approximately a same outside diameter as that of the seal ring.

* * * * *